United States Patent [19]

Cheater

[11] Patent Number: 4,555,879

[45] Date of Patent: Dec. 3, 1985

[54] CLADDING SYSTEMS

[76] Inventor: Maurice J. Cheater, Edenvale, South Africa

[21] Appl. No.: 652,080

[22] Filed: Sep. 20, 1984

[30] Foreign Application Priority Data

Dec. 12, 1983 [ZA] South Africa ..... 83/9228

[51] Int. Cl.[4] ..... E04B 7/02

[52] U.S. Cl. ..... 52/90

[58] Field of Search ..... 52/90, 489, 478, 727, 52/730

[56] References Cited

U.S. PATENT DOCUMENTS

| | | | |
|---|---|---|---|
| 3,236,932 | 2/1966 | Grigas et al. | 174/2 |
| 3,347,009 | 10/1967 | Meddick | 52/545 |
| 4,047,349 | 9/1977 | Aguilar | 52/551 |
| 4,120,132 | 10/1978 | Kendrick | 52/478 |
| 4,281,497 | 8/1981 | Luotonen et al. | 52/730 |
| 4,400,922 | 8/1983 | Boyer | 52/478 |
| 4,498,801 | 2/1985 | Gilb | 52/90 |
| 4,499,700 | 2/1985 | Gustafsson | 52/478 |

*Primary Examiner*—Lenard A. Footland

*Attorney, Agent, or Firm*—Kinzer, Plyer, Dorn & McEachran

[57] ABSTRACT

One aspect of the invention is concerned with a support member for use in supporting cladding sheets. The support member includes a timber length capped by a metallic rail carrying spaced cleats. The cleats are deformable to grip the edges of cladding sheets laid over the support member, and the rail is connected to the timber over its entire length, so reinforcing the timber length. Other aspects of the invention are concerned with roof trusses in which such support members form the top chords, and with cladding systems in which the support members are used.

6 Claims, 3 Drawing Figures

CLADDING SYSTEMS

BACKGROUND TO THE INVENTION

This invention relates to cladding systems in which cladding sheets are fastened to a supporting structure to cover the structure.

Cladding systems of this general type are already known in which the supporting structure is formed with clips arranged to clip the sheets in position. In general, the sheets overlap one another with a hook at one edge of one sheet engaging a formation, usually a rolled formation, at the adjacent edge of a similar, neighbouring sheet. The first-mentioned sheet has, on its edge opposite to the hooked edge, a formation for engagement by the hook of a neighbouring sheet on the opposite side.

In one known system, members of the supporting structure have clips in the form of cleats which are deformed over the formations of the sheets to hold them to the structure. For industrial applications, where one is dealing with large spans, the supporting structure is usually fabricated as a truss from steel members, and the cleats can be stamped from the steel of the members. Where the loading and correspondingly the spans, are less, timber members are preferred, and the cleats then have to be separate components which are fastened to the timber. The cleats have to be accurately positioned to mate correctly with the cladding sheets, which will usually have standard dimensions. The solution to the problem of accurate cleat spacing has been to fasten elongate rails to the timber members using spaced screws, the rails having the cleats stamped from them at the correct intervals. The problem nevertheless remains that the timber members are usually of fairly large cross-section so that they have sufficient structural strength to resist the imposed loads. A large amount of timber is required.

U.S. Pat. No. 3,236,932 (Grigas) describes a system in which vertical "furring strips" 24 are rivetted or nailed at intervals to upright members of timber. The furring strips have non-deformable cleats which are used to engage the cladding sheets. Because the "furring strips" are not fastened intimately and continuously to the upright member, they do not reinforce the member to any great degree i.e the "furring strips" serve only for the connection of the cladding.

In U.S. Pat. No. 3,347,009 (Meddick) nails 15 serve to secure a rail 12 to a member 13 at spaced intervals. The rail carries non-deformable formations 16, 17 for the connection of cladding sheets. Once again, the rail serves only to support the cladding sheets without providing reinforcement for the member 13.

In U.S. Pat. No. 4,047,349, a rail 18 has deformable cleats which are used to engage cladding sheets. The rail is fastened at spaced intervals to a vertical member 12, but again endows that member with no real added strength.

In the composite beams seen in U.S. Pat. No. 4,281,497, there is a U-shaped flange which is connected to a member at spaced intervals by means of spaced tabs which bite into the material of the member. Further tabs, in conjunction with bolts or screws can be used to secure cladding sheets to the flange.

One object of the invention is to provide a support member for a cladding system in which support member there is a rail which is secured continuously and intimately to a timber member to reinforce it, and which has easily deformable cleats which allow for rapid connection of cladding sheets to the rail. Other objects of the invention include the provision of a cladding system employing such a support member.

SUMMARY OF THE INVENTION

The invention provides a support member for use in supporting cladding sheets in a cladding system and comprising a length of timber and an elongate metallic rail which has basically a U-shape in cross-section, which carries a series of spaced cleats deformable to engage the cladding sheets and hold them to the support member, and which extends lengthwise along the length of timber with continuous, inwardly directed lips at the free ends of its flanges locating snugly in continuous, longitudinally extending grooves formed on opposite sides of the length of timber, the rail serving in use both for engagement of the cladding sheets and as reinforcement for the timber.

The invention also provides a cladding system including a support member of the type set forth above and a plurality of cladding sheets, each cladding sheet having along one edge a hook formation and along the opposite edge a formation engagable by the hook formation of an adjacent sheet when the sheets are laid in overlapping side-by-side relationship on the support member, the formations on the sheets which are engagable by the hook formations on adjacent sheets also being engagable by the cleats of the support member to hold the sheets on the support member when the cleats are deformed over those formations.

A further aspect of the invention provides a roof truss in which the support member forms the top chord of the truss.

Yet another aspect of the invention provides a roof cladding system which includes such trusses, a plurality of cladding sheets for spanning transversely across the trusses in side-by-side overlapping relationship, each cladding sheet having a hook formation along one edge there of for engagement with a corresponding formation on an adjacent sheet, and the last-mentioned formations on the sheets being engagable by the cleats of the support members on deformation thereof to hold the sheets on the trusses.

SPECIFIC DESCRIPTION

Figure 1:
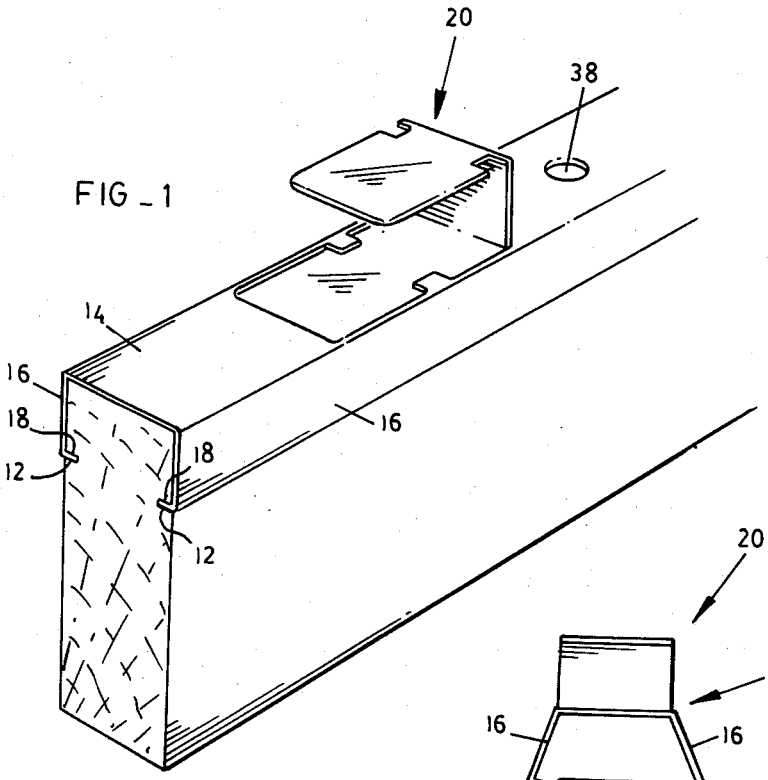
FIG. 1 shows a perspective view of part of a support member in accordance with this invention.

The support member illustrated in FIG. 1 includes a length of rectangular cross-section timber 10 formed with longitudinally extending grooves 12 on opposite sides. A basically U-shaped steel rail 14 seats on the upper edge of the timber length and extends for the full length of the timber, with the flanges 16 of the U-shape overhanging the sides of the timber and with a series of cleats 20 (only one shown) stamped from the web of the U-shape. At their lower edges, the flanges carry inwardly directed lips 18 which are located snugly in the grooves 12. The rail is therefore connected intimately to the timber for its entire length and forms, in combination with the timber, a composite member. The rail serves as reinforcement for the timber to inhibit bending thereof as a result of both vertical and horizontal loading.

A major advantage of the composite support member is the fact that the timber can have a cross-section somewhat smaller than that of an equivalent member formed solely of timber, because of the reinforcement provided by the steel rail 14. This in turn means that the timber cost is reduced.

Figure 2:
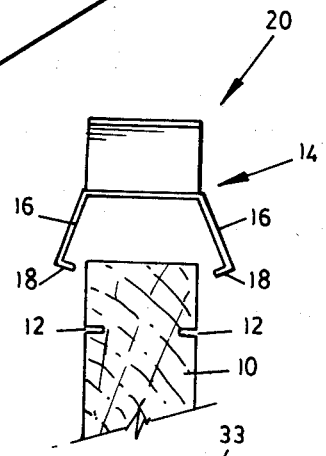
FIG. 2 shows how the support member of FIG. 1 is produced.

Referring now to FIG. 2, the rail has the shape shown in this Figure before connection to the timber length. The flanges 16 are slightly splayed, enabling the rail to be seated on the timber member with the lips 18 next to the grooves 12. The flanges are deformed in a continuous pressing operation to force the lips into the grooves and complete the connection between rail and timber.

Figure 3:
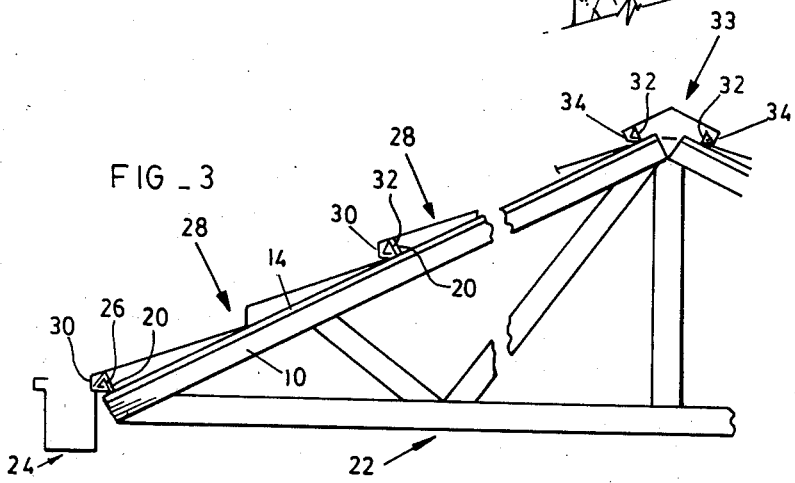
FIG. 3 shows a cladding system employing support members of FIG. 1.

FIG. 3 shows a roof cladding system in which the support member of FIG. 1 forms the top chord of an otherwise conventional roof truss shown partially at 22. There is a gutter 24 having the cross-sectional shape shown. The lowest cleat 20 on the top chord is deformed as shown to engage a rolled formation 26 at one edge of the gutter 24 to hold the gutter to the truss. Next, cladding sheets 28 are laid side by side to span transversely across the top chords of adjacent trusses. A rolled formation 30 at the lower edge of the first cladding sheet 28 is engaged with the formation 26 over the deformed cleat. The corresponding rolled formation 30 at the lower edge of the next cladding sheet is then engaged as shown with a rolled formation 32 at the upper edge of the first sheet after the next cleat has been deformed to engage the formation 32. The cladding sheets are laid one by one towards the ridge of the roof, where a ridge cap 33 having edge formations 34 is engaged with the formations 32 of the last cladding sheets to span the ridge of the roof.

The support member of the invention is not limited to its application in roof cladding. It could equally well be used in wall cladding systems, the member in this case being vertical.

In either case, the system has the important advantage that no holes are formed in the cladding sheets, engagement of the sheets being achieved solely by deformation of the cleats to hold the sheets to the supporting structure. Note in FIG. 1 that the rail is formed with a series of holes 38 next to the cleats, which holes provide some purchase for a suitable levering tool used to deform the cleats to the shapes shown in FIG. 3.

I claim:

1. A support member for use in supporting cladding sheets in a cladding system and comprising a length of timber and an elongate metallic rail which has basically a U-shape in cross-section, which carries a series of spaced cleats deformable to engage the cladding sheets and hold them to the support member, and which extends lengthwise along the length of timber with continuous, inwardly directed lips at the free ends of its flanges locating snugly in continuous, longitudinally extending grooves formed on opposite sides of the length of timber so that the rail is connected intimately to the timber over its full length, the rail serving in use both for engagement of the cladding sheets and as reinforcement for the timber.

2. The support member of claim 1, in which the flanges of the rail are deformed for the lips to engage in the grooves.

3. A cladding system including a support member according to claim 1 and a plurality of cladding sheets, each cladding sheet having along one edge a hook formation and along the opposite edge a formation engagable by the hook formation of an adjacent sheet when the sheets are laid in overlapping side-by-side relationship on the support member, the formations on the sheets which are engagable by the hook formations on adjacent sheets also being engagable by the cleats of the support member to hold the sheets on the support member when the cleats are deformed over those formations.

4. A roof truss in which a support member according to claim 1 forms the top chord of the truss.

5. A roof cladding system which includes trusses according to claim 4, a plurality of cladding sheets for spanning transversely across the trusses in side-by-side overlapping relationship, each cladding sheet having a hook formation along one edge thereof for engagement with a corresponding formation on an adjacent sheet, and the last-mentioned formations on the sheets being engagable by the cleats of the support members on deformation thereof to hold the sheets on the trusses.

6. A cladding system according to claim 5, and including a gutter engagable by the hook formation on the operatively lowest cladding sheet and by the operatively lowest cleats on the trusses and a ridge cap engagable with the operatively uppermost cladding sheets to span between the operatively uppermost cladding sheets on opposite sides of the trusses.

* * * * *